US008496783B2

(12) United States Patent
Mellin et al.

(10) Patent No.: US 8,496,783 B2
(45) **Date of Patent: *Jul. 30, 2013**

(54) WEB SUBSTRATE HAVING OPTIMIZED EMBOSS DESIGN

(71) Applicant: The Procter & Gamble Company, Cincinnati, OH (US)

(72) Inventors: André Mellin, Amberley Village, OH (US); Kevin Benson McNeil, Cincinnati, OH (US); Thomas Timothy Byrne, West Chester, OH (US); Jason Merrill Jones, Lebanon, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/688,294

(22) Filed: Nov. 29, 2012

(65) Prior Publication Data

US 2013/0089711 A1 Apr. 11, 2013

Related U.S. Application Data

(63) Continuation of application No. 12/468,252, filed on May 19, 2009, now Pat. No. 8,328,984.

(51) Int. Cl.
*D21H 11/00* (2006.01)

(52) U.S. Cl.
USPC ..... 162/109

(58) Field of Classification Search
USPC ..... 162/109, 111; 428/43, 154, 156, 428/166; 156/292; 264/293
See application file for complete search history.

(56) References Cited

U.S. PATENT DOCUMENTS

| | | | | |
|---|---|---|---|---|
| 3,414,459 | A | 12/1968 | Edward | |
| 3,547,723 | A | 12/1970 | Gresham | |
| 3,556,907 | A | 1/1971 | Nystrand | |
| 3,708,366 | A | 1/1973 | Donnelly | |
| 3,738,905 | A | 6/1973 | Thomas | |
| 3,867,225 | A | 2/1975 | Nystrand | |
| 3,994,771 | A | 11/1976 | Morgan, Jr. et al. | |
| 4,166,001 | A | 8/1979 | Dunning et al. | |
| 4,300,981 | A | 11/1981 | Carstens | |
| 4,483,728 | A | 11/1984 | Bauernfeind | |
| 5,294,475 | A | 3/1994 | McNeil | |
| 5,415,737 | A | 5/1995 | Phan et al. | |
| 5,468,323 | A | 11/1995 | McNeil | |
| 5,510,000 | A | 4/1996 | Phan et al. | |
| 5,538,595 | A | 7/1996 | Trokhan et al. | |
| 5,543,067 | A | 8/1996 | Phan et al. | |
| 5,686,168 | A | 11/1997 | Laurent et al. | |
| 5,846,636 | A | 12/1998 | Ruppel et al. | |
| 6,086,715 | A | 7/2000 | McNeil | |
| 6,277,466 | B1 | 8/2001 | McNeil et al. | |
| 6,395,133 | B1 | 5/2002 | McNeil | |
| 6,413,614 | B1 | 7/2002 | Giesler et al. | |
| 6,846,172 | B2 | 1/2005 | Vaughn et al. | |
| 8,328,984 | B2 * | 12/2012 | Mellin et al. | 162/109 |
| 2008/0264275 | A1 | 10/2008 | Wilhelm et al. | |

FOREIGN PATENT DOCUMENTS

| | | | |
|---|---|---|---|
| EP | 0 613 979 | A1 | 9/1994 |
| EP | 0 688 901 | A2 | 12/1995 |
| EP | 2 048 283 | | 4/2009 |

OTHER PUBLICATIONS

PCT International Search Report, mailed Aug. 10, 2010, 6 pages.

* cited by examiner

*Primary Examiner* — Mark Halpern
(74) *Attorney, Agent, or Firm* — Peter D. Meyer

(57) ABSTRACT

The present disclosure provides for a web substrate having at least one embossed ply having a surface thereof. The surface has surface area comprising from about 10.0 percent to about 20.0 percent line embossments.

19 Claims, 3 Drawing Sheets

WEB SUBSTRATE HAVING OPTIMIZED EMBOSS DESIGN

PRIORITY DATA

This application is a continuation of U.S. application Ser. No. 12/468,252 filed May 19, 2009.

FIELD OF THE INVENTION

This invention relates, in general, to tissue paper products. More specifically, it relates to tissue paper products having optimized emboss designs applied thereto.

BACKGROUND OF THE INVENTION

Sanitary paper tissue and towel products are widely used. Such items are commercially offered in formats tailored for a variety of uses such as facial tissues, toilet tissues and absorbent towels.

In order to be consumer preferred, the tissue/towel product needs to be aesthetically pleasing. The aesthetically pleasing tissue paper is typically an embossed substrate. Embossing of webs can provide improvements to the web such as increased bulk, improved water holding capacity, improved aesthetics and other benefits. Both single ply and multiple ply (or multi-ply) webs are known in the art and can be embossed. Multi-ply paper webs are webs that include at least two plies superimposed in face-to-face relationship to form a laminate.

During a typical embossing process, a web substrate is fed through a nip formed between juxtaposed generally axially parallel rolls. Embossing elements on the rolls compress and/or deform the web. If a multi-ply product is being formed, two or more plies are fed through the nip and regions of each ply are brought into a contacting relationship with the opposing ply. The embossed regions of the plies may produce an aesthetic pattern and provide a means for joining and maintaining the plies in face-to-face contacting relationship.

Embossing is typically performed by one of two processes; knob-to-knob embossing or nested embossing. Knob-to-knob embossing typically consists of generally axially parallel rolls juxtaposed to form a nip between the embossing elements on opposing rolls. Nested embossing typically consists of embossing elements of one roll meshed between the embossing elements of the other roll. Examples of knob-to-knob embossing and nested embossing are illustrated in the U.S. Pat. Nos. 3,414,459; 3,547,723; 3,556,907; 3,708,366; 3,738,905; 3,867,225; 4,483,728; 5,468,323; 6,086,715; 6,277,466; 6,395,133; and, 6,846,172 B2.

Knob-to-knob embossing generally produces a web comprising pillowed regions which can enhance the thickness of the product. However, the pillows have a tendency to collapse under pressure due to lack of support. Consequently, the thickness benefit is typically lost during the balance of the converting operation and subsequent packaging, diminishing the quilted appearance and/or thickness benefit sought by the embossing.

During the embossing process, the plies are fed through a nip formed between juxtaposed axially parallel rolls. Embossment knobs on these rolls compress like regions of each ply into engagement and contacting relationship with the opposing ply. The compressed regions of the plies produce an aesthetic pattern and provide a means for joining and maintaining the plies in to face-to-face contacting relationship.

Nested embossing has proven to be the preferred process for producing products exhibiting a softer more quilted appearance that is maintained throughout the balance of the converting process including packaging. With nested embossing, one ply has a male pattern, while the other ply has a female pattern. As the two plies travel through the nip of the embossment rolls, the patterns are meshed together. Nested embossing aligns the knob crests on the male embossment roll with the low areas on the female embossment roll. As a result, the embossed sites produced on one ply provide support for the embossed sites on the other ply.

The nested embossment rolls may be designed such that the knobs on one roll contact the periphery of the other embossing roll providing a lamination point, thereby eliminating the need for a marrying roll. Such nested embossing arrangement is shown in U.S. Pat. No. 5,468,323 issued Nov. 21, 1995 to McNeil. This arrangement also provides a means for improving the bond strength between the plies by enabling a glue applicator roll to be used in conjunction with each of the embossment rolls providing an adhesive joint at each of the embossed sites.

Consumer testing of products having embossed cellulosic fibrous structures have determined that a softer, more quilted appearance is desired. Consumers desire products having relatively high caliper with aesthetically pleasing decorative patterns exhibiting a high quality cloth-like appearance. Such attributes must be provided without sacrificing the products' other desired qualities of softness, absorbency, drape (limpness) and bond strength between the plies.

Different attempts have been made in the art to produce paper products exhibiting superior functional properties as well as aesthetically pleasing decorative qualities. The present invention provides an embossed multiple ply tissue where the embossment patterns on each of the two plies are designed with specific objectives in mind. For instance, the embossed pattern on the first ply is based primarily on aesthetics while the embossed pattern on the second ply is based primarily on functional properties such as thickness and strength. In addition, the quantity and locations of the connections between the two plies are limited in order to coordinate the bond strength between the two plies with softness and drape of the final product. Another type of embossing, deep-nested embossing, has been developed and used to provide unique characteristics to the embossed web. Deep-nested embossing refers to embossing that utilizes paired emboss elements, wherein the protrusions from the different embossing elements are coordinated such that the protrusions of one embossing element fit into the space between the protrusions of the other embossing element. Although many deep-nested embossing processes are configured such that the embossing elements of the opposing embossing members do not touch each other or the surface of the opposing embossing member, embodiments are contemplated wherein the deep-nested embossing process includes tolerance such that the embossing elements touch each other or the surface of the opposing embossing member when engaged. (Of course, in the actual process, the embossing members generally do not touch each other or the opposing embossing member because the web is disposed between the embossing members.) Exemplary deep-nested embossing techniques are described in U.S. Pat. Nos. 5,686,168 and 5,294,475.

Accordingly, it would be desirable to provide an embossed tissue product that is more aesthetically pleasing than prior attempts. It is believed that managing the amount of embossments that are provided as 'dots' and those provided as 'line art' provide just this consumer appeal. Alternatively, providing an embossed tissue product with a known embossment 'footprint' can also provide significant consumer appeal.

SUMMARY OF THE INVENTION

An exemplary and non-liming embodiment of the present disclosure provides for a web substrate having at least one embossed ply having a surface thereof. The surface has surface area comprising from about 10.0 percent to about 20.0 percent line embossments.

Another exemplary and non-limiting embodiment of the present disclosure provides for a web substrate having at least two plies. One of the two plies has a surface area and has an embossing pattern disposed thereon. The embossing pattern has a surface area relative to the surface area of the one of the two plies comprising from about 10.0 percent to about 20 percent line embossments.

DETAILED DESCRIPTION OF THE INVENTION

Figure 1:
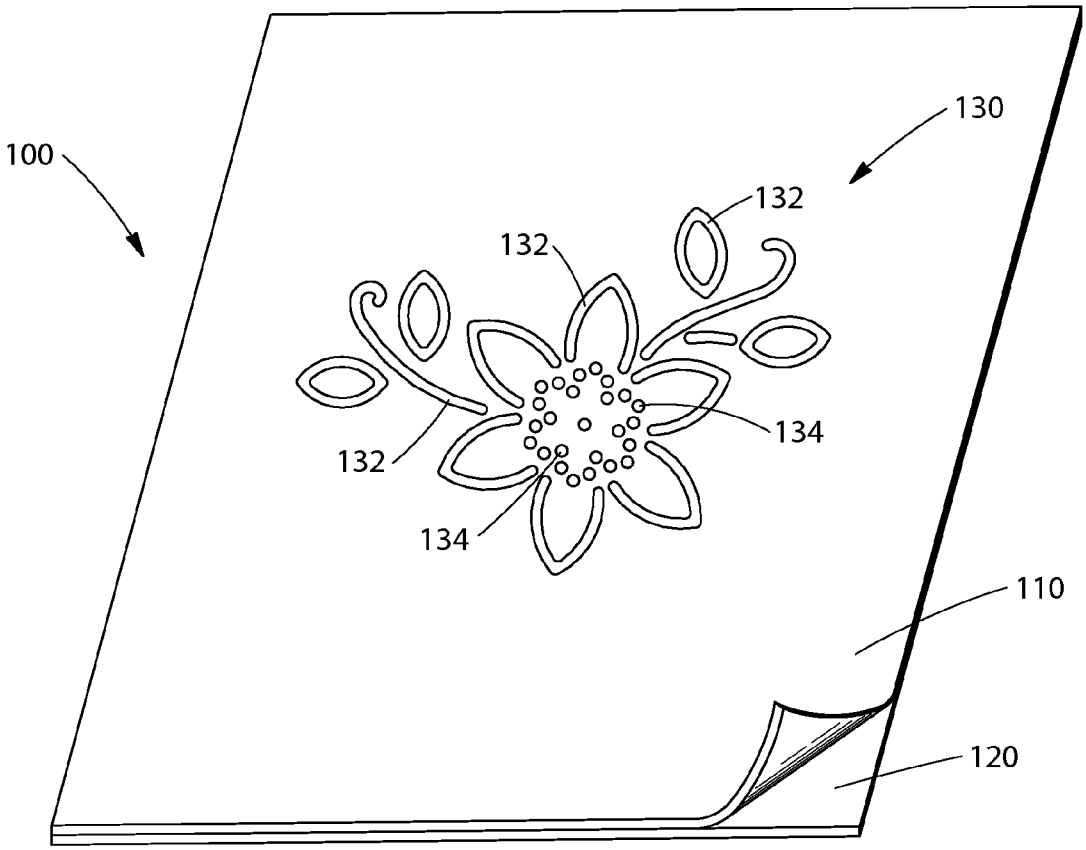
FIG. 1 is a perspective view of an exemplary embodiment of an exemplary emboss pattern suitable for use with the present invention.

As used herein, the term "water soluble" refers to materials that are soluble in water to at least 3%, by weight, at 25° C.

"Basis Weight" as used herein is the weight per unit area of a sample reported in lbs/3000 $ft^2$ or $g/m^2$ and is measured according to the Basis Weight Test Method described herein.

As used herein, the terms "tissue paper web," "paper web," "web," "paper sheet," "tissue paper," "tissue product," "fibrous structure," "tissue/towel product," and "paper product" are all used interchangeably to refer to sheets of paper made by a process comprising the steps of forming an aqueous papermaking furnish, depositing this furnish on a foraminous surface, such as a Fourdrinier wire, and removing the water from the furnish (e.g., by gravity or vacuum-assisted drainage), forming an embryonic web, transferring the embryonic web from the forming surface to a transfer surface traveling at a lower speed than the forming surface. The web is then transferred to a fabric upon which it is through air dried to a final dryness after which it is wound upon a reel.

The terms "multi-layered tissue paper web", "multi-layered paper web", "multi-layered web", "multi-layered paper sheet," and "multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

As used herein, the term "single-ply tissue product" means that it is comprised of one ply of creped or un-creped tissue; the ply can be substantially homogeneous in nature or it can be a multi-layered tissue paper web. As used herein, the term "multi-ply tissue product" means that it is comprised of more than one ply of creped or uncreped tissue. The plies of a multi-ply tissue product can be substantially homogeneous in nature or they can be multi-layered tissue paper webs.

As used herein, "machine direction" means the direction of travel of a product of the present invention through any manufacturing or processing equipment. The term "cross-machine direction" means the direction co-planar and orthogonal to the machine direction. The term "z-direction" means that direction orthogonal to both the machine direction and the cross-machine direction.

The fibrous structure of the present invention may exhibit a basis weight of greater than 15 $g/m^2$ (9.2 lbs/3000 $ft^2$) to about 120 $g/m^2$ (73.8 lbs/3000 $ft^2$) and/or from about 15 $g/m^2$ (9.2 lbs/3000 $ft^2$) to about 110 $g/m^2$ (67.7 lbs/3000 $ft^2$) and/or from about 20 $g/m^2$ (12.3 lbs/3000 $ft^2$) to about 100 $g/m^2$ (61.5 lbs/3000 $ft^2$) and/or from about 30 (18.5 lbs/3000 $ft^2$) to 90 $g/m^2$ (55.4 lbs/3000 $ft^2$). In addition, the sanitary tissue products and/or fibrous structures of the present invention may exhibit a basis weight between about 40 $g/m^2$ (24.6 lbs/3000 $ft^2$) to about 120 $g/m^2$ (73.8 lbs/3000 $ft^2$) and/or from about 50 $g/m^2$ (30.8 lbs/3000 $ft^2$) to about 110 $g/m^2$ (67.7 lbs/3000 $ft^2$) and/or from about 55 $g/m^2$ (33.8 lbs/3000 $ft^2$) to about 105 $g/m^2$ (64.6 lbs/3000 $ft^2$) and/or from about 60 (36.9 lbs/3000 $ft^2$) to 100 $g/m^2$ (61.5 lbs/3000 $ft^2$).

The fibrous structure products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

The fibrous structure of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The fibrous structure of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The fibrous structure of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The fibrous structure of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The soft tissue paper of the present invention further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The tissue paper product of the present invention is preferably creped, i.e., produced on a papermaking machine culminating with a Yankee dryer to which a partially dried papermaking web is adhered and upon which it is dried and from which it is removed by the action of a flexible creping blade.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large diameter, generally 8-20 foot drum which is designed to be pressurized with steam to provide a hot surface for completing the drying of papermaking webs at the end of the papermaking process. The paper web which is first formed on a foraminous forming carrier, such as a Fourdrinier wire, where it is freed of the copious water needed to disperse the fibrous slurry is generally transferred to a felt or fabric in a so-called press section where de-watering is continued either by mechanically compacting the paper or by some other de-watering method such as through-drying with hot air, before finally being transferred in the semi-dry condition to the surface of the Yankee for the drying to be completed.

While the characteristics of the creped paper webs, particularly when the creping process is preceded by methods of pattern densification, are preferred for practicing the present invention, un-creped tissue paper is also a satisfactory substitute and the practice of the present invention using un-creped tissue paper is specifically incorporated within the scope of the present invention. Un-creped tissue paper, a term as used herein, refers to tissue paper which is non-compressively dried, most preferably by through-drying. Resultant through air dried webs are pattern densified such that zones of relatively high density are dispersed within a high bulk field, including pattern densified tissue wherein zones of relatively high density are continuous and the high bulk field is discrete.

To produce un-creped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps. Additionally, filler materials may also be incorporated into the tissue papers of the present invention.

Preferably, softening agents such as quaternary ammonium compounds can be added to the papermaking slurry. Such softening agents can include dialkyldimethylammonium salts (e.g. ditallowedimethylammonium chloride, ditallowedimethylammonium methyl sulfate, di(hydrogenated tallow)dimethyl ammonium chloride, etc. Particularly preferred variants of these softening agents are what are considered to be mono- or di-ester variations of quaternary ammonium compounds.

Specific examples of ester-functional quaternary ammonium compounds having the structures detailed above and suitable for use in the present invention may include the diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated)tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

Typically, half of the fatty acids present in tallow are unsaturated, primarily in the form of oleic acid. Synthetic as well as natural "tallows" fall within the scope of the present invention. It is also known that depending upon the product characteristic requirements desired in the final product, the saturation level of the ditallow can be tailored from non hydrogenated (soft) to touch, partially or completely hydrogenated (hard). Other types of suitable quaternary ammonium compounds for use in the present invention are described in U.S. Pat. Nos. 5,543,067; 5,538,595; 5,510,000; 5,415,737, and European Patent Application No. 0 688 901 A2. Di-quaternary variations of the ester-functional quaternary ammonium compounds can also be used, and are meant to fall within the scope of the present invention. All of above-described levels of saturations are expressly meant to be included within the scope of the present invention.

It is anticipated that wood pulp in all its varieties will normally comprise the tissue papers with utility in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, ThermoMechanical Pulp (TMP) and Chemi-ThermoMechanical Pulp (CTMP). Pulps derived from both deciduous and coniferous trees can be used.

Hardwood pulps and softwood pulps, as well as combinations of the two, may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises the use of layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

In one preferred embodiment of the present invention, which utilizes multiple papermaking furnishes, the furnish containing the papermaking fibers which will be contacted by the particulate filler is predominantly of the hardwood type, preferably of content of at least about 80% hardwood.

Other materials can be added to the aqueous papermaking furnish or the embryonic web to impart other characteristics to the product or improve the papermaking process so long as they are compatible with the chemistry of the softening agent and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

The present invention is further applicable to the production of multi-layered tissue paper webs. Multi-layered tissue structures and methods of forming multi-layered tissue structures are described in U.S. Pat. Nos. 3,994,771; 4,300,981; 4,166,001; and European Patent Publication No. 0 613 979 A1. The layers preferably comprise different fiber types, the fibers typically being relatively long softwood and relatively short hardwood fibers as used in multi-layered tissue paper making. Multi-layered tissue paper webs resultant from the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fiber having an average fiber length of least about 2.0 mm. These long paper making fibers are typically softwood fibers, preferably, northern softwood Kraft fibers. Preferably, the majority of the particulate filler of the present invention is contained in at least one of the outer layers of the multi-layered tissue paper web of the present invention. More preferably, the majority of the particulate filler of the present invention is contained in both of the outer layers.

The tissue paper products made from single-layered or multi-layered un-creped tissue paper webs can be single-ply tissue products or multi-ply tissue products.

The multi-layered tissue paper webs of to the present invention can be used in any application where soft, absorbent multi-layered tissue paper webs are required. Particularly advantageous uses of the multi-layered tissue paper web of this invention are in toilet tissue and facial tissue products. Both single-ply and multi-ply tissue paper products can be produced from the webs of the present invention.

The process of the present invention generally involves the production of a web substrate having at least one surface provided with an embossing pattern on the surface thereof. By way of non-limiting example, a tissue product may be an uncreped through air-dried paper web that has been formed on a three-dimensional surface in a manner that produces surface texture. In this example, a fibrous structure comprises contacting a molding member comprising a design element with a fibrous structure such that the design element is imparted to the fibrous structure. The molding member may be a belt that comprises a design element. Alternatively, a paper web may be processed after formation through an embossing system to provide a three-dimensional texture to the resulting structure. A design element can be imparted to a fibrous structure comprises passing a fibrous structure through an embossing nip formed by at least one embossing roll comprising a design element such that the design element is imparted to the fibrous structure.

In any regard, to provide for the multi-ply substrate, an adhesive is applied to the embossment formed on the resulting paper substrate, and the resulting tissue webs are bonded in super posed relation to produce a laminated product. As mentioned previously, bonding is typically affected by disposing an adhesive between the webs in accordance with a pattern of application. Typically, the adhesive may be a thermoplastic resin. Polyvinyl alcohol in an aqueous medium is one such example.

Figure 2:
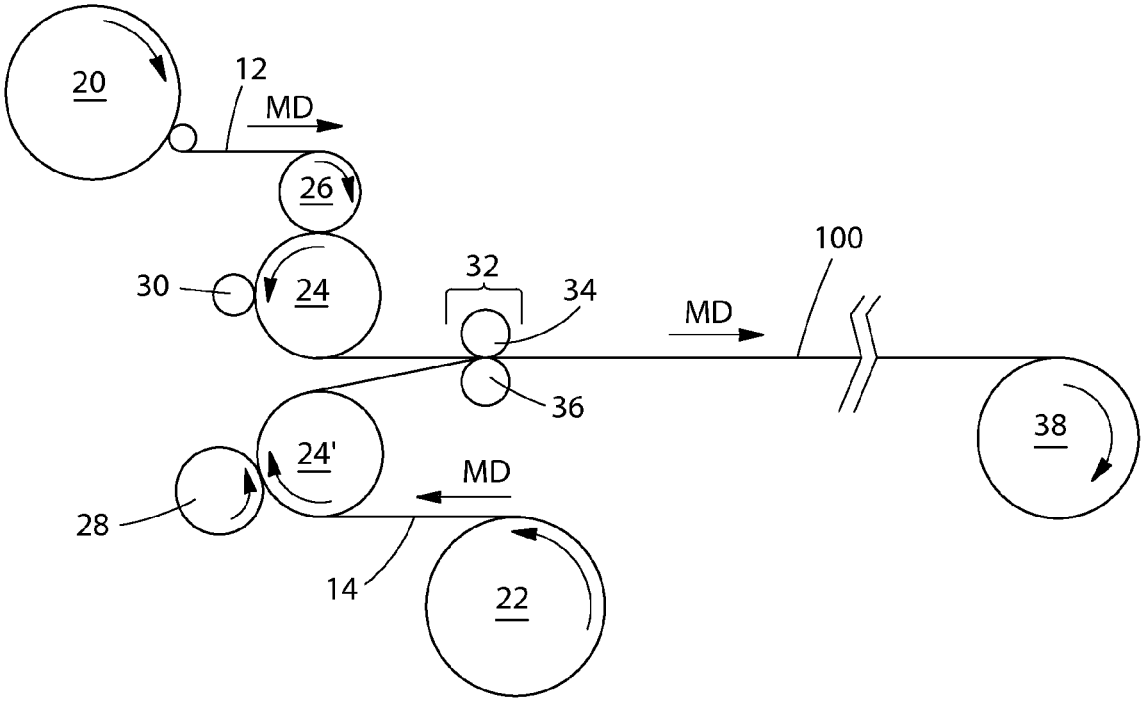
FIG. 2 is a cross-sectional view of a process suitable for use in manufacturing a product suitable for use with the present invention; and, FIG. 3 is a perspective view of the embodiment of FIG. 1 showing an exemplary emboss pattern footprint.

As shown in FIG. 1, two or more of the paper webs 110 and 120 having desired characteristics relative to one another and having an embossing pattern 130 disposed thereon are combined to provide the multiple ply tissue paper product of the present invention. FIG. 2 illustrates equipment that can be used to combine two webs having desired characteristics relative to one another in order to form a two ply product according to the present invention. Two single ply webs 12 and 14 are unwound from rolls 20 and 22, respectively. Each of the webs 12 and 14 can have regions of different density, and each ply can have a continuous network region having a relatively high density, and discrete domes having relatively low densities. The two webs 12 and 14 are carried in the directions indicated. Web 12 corresponds to ply 110 in FIG. 1 and web 14 corresponds to ply 120 in FIG. 1.

Web 12 is directed through a nip formed between a rubber roll 26 and a steel embossing roll 24 and web 14 is directed through a nip formed between rubber roll 28 and steel embossing roll 24'. The steel embossing rolls 24 and 24' have a pattern of embossing elements which contact and deform selective, discrete portions of the webs 12 and 14, respectively. The web 12 is then carried through a nip formed between a glue applicator roll 30 and the steel embossing roll 24. The glue applicator roll 30, which has a surface which is continuously replenished with glue, transfers glue to the deformed portions of the web 12.

The two webs 12 and 14 then pass through a nip formed by marrying rolls 32 having a pre-determined nip loading between rolls 34 and 36. Marrying rolls 32 may have a hard rubber cover, and serve to press the webs 12 and 14 together to ensure bonding of web 12 to web 14 at those locations where adhesive is transferred from glue application roll 30 to ply 12. The resulting two ply paper structure 100 can be rewound into rolls 38 for later converting into smaller rolls.

Referring again to FIG. 1, two ply paper structure 100 where at least one of the two plies has an embossing pattern 130 disposed thereupon. The embossing pattern 130 preferably comprises 'line' emboss elements 132 and 'dot' emboss elements 134. A line emboss element 132 can be placed upon web 12 and/or web 14 by any emboss process known to those of skill in the art as well as the process described supra. A line emboss element 132 can be characterized by having a depth relative to the surface of the respective surface of web 12 and/or web 14. A line emboss element 132 is also characterized by having a total embossment length to total embossment width (or an aspect ratio) of greater than 1. A dot emboss element 134 can be placed upon web 12 and/or web 14 by any emboss process known to those of skill in the art as well as the process described supra. A dot emboss element 134 can be characterized by having a depth relative to the surface of the respective surface of web 12 and/or web 14. A dot emboss element 134 is also characterized by having a total embossment length to total embossment width (or an aspect ratio) of 1.

It was surprisingly found that the amount of dot embossments and line embossments present on the two ply paper structure 100 could be adjusted relative to the total surface area of the two ply paper structure 100 to produce a consumer preferred product. In other words, a consumer preferred product can be produced by adjusting the percentage of area occupied by dot embossments and the percentage of area occupied by line embossments relative to the total surface area of the two ply paper structure 100.

TABLE 1

Comparison of 'dot' embossments and 'line' embossments relative to the total surface area of a sheet material.

| Product | % surface occupied by 'dot' embossments | % surface occupied by 'line' embossments |
|---|---|---|
| Bounty Paper Towel | 10.0 | 0.0 |
| K-C Product | 6.0 | 2.0 |
| Charmin Ultra Strong | 3.0 | 3.0 |
| G.P. Quilted Northern | 8.0 | 3.0 |
| SCA Tissue | 0.0 | 3.5 |
| First Quality Paper Towel | 0.0 | 5.5 |
| Present Invention #1 | 1.0 | 7.5 |
| Present Invention #2 | 0.5 | 10.0 |

A preferred embodiment of the present invention provides a % surface area occupied by 'dot' element embossments and a corresponding percent surface area occupied by 'line' element embossments disposed upon the total surface area of a web material ranging from about 0.0 percent to about 1.2 percent 'dot' element embossments and about 5.0 percent to about 20.0 percent 'line' element embossments, more preferably ranging from about 0.3 percent to about 1.0 percent 'dot' element embossments and about 6.0 percent to about 10.0 percent 'line' element embossments, and most preferably ranging from about 0.45 percent to about 0.70 percent 'dot' element embossments and about 6.5 percent to about 7.9 percent 'line' element embossments.

Another preferred embodiment of the present invention provides a embossed web substrate having a total surface area comprising at least about 0.20 percent of the total surface area as 'dot' embossments and at least about 0.2 percent of the total surface area as 'line' embossments where the ratio of 'line' embossments to 'dot' embossments is greater than 1.0, more preferably the ratio of 'line' embossments to 'dot' embossments is greater than 1.5, even more preferably the ratio of 'line' embossments to 'dot' embossments is greater than 2.0, yet more preferably the ratio of 'line' embossments to 'dot' embossments is greater than 3.0.

If only 'line' element embossments are present in the embossing pattern 130 then the percent surface area occupied by 'line' element embossments disposed upon the total surface are of a sheet of a resulting paper structure ranges from about 5.0 percent to about 20.0 percent, more preferably ranges from about 5.0 percent to about 12.0 percent, even more preferably ranges from about 6.0 percent to about 10.0 percent, and most preferably ranges from about 6.5 percent to about 7.9 percent.

In one example, the step of imparting a design element to a fibrous structure comprises contacting a molding member comprising a design element with a fibrous structure such that the design element is imparted to the fibrous structure. The molding member may be a belt that comprises a design element. In another example, the step of imparting a design element to a fibrous structure comprises passing a fibrous structure through an embossing nip formed by at least one embossing roll comprising a design element such that the design element is imparted to the fibrous structure.

Figure 3:
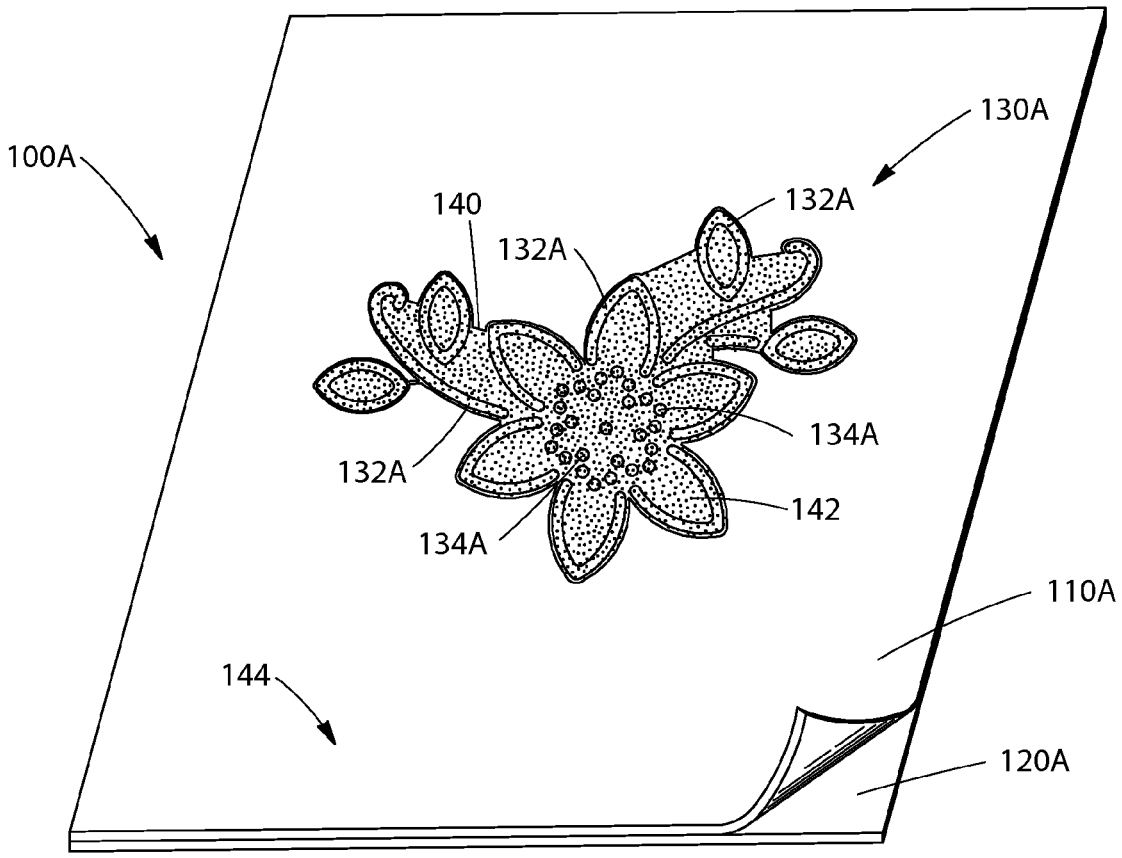

As shown in FIG. 3, two ply paper structure 100A comprising two or more paper webs 110A and 120A can be provided with an embossing pattern 130A thereon. The embossing pattern 130A can be provided with any combination of line emboss elements 132A and dot emboss elements 134A.

It is believed that managing the amount of surface area occupied by the embossing pattern 130A relative to the total available surface area of the two ply paper structure 100A can provide for a more consumer preferred two ply paper structure 100A. The resulting structure was to surprisingly found to be consumer preferred because the embossing pattern 130A was more recognizable. Without desiring to be bound by theory, it is believed that the increased recognition is due to the fact that the regular repeating embossing pattern 130A is more visible on the resulting two ply paper structure 100A. This is compared to a paper structure having what amounts to a 'random registration' as the pattern traverses across the paper structure. A pattern that is randomly registered has an embossing pattern that repeats over any particular given area, but does not have a regular appearance on a plurality of sequential user units.

A 'user unit' is hereby utilized for the products subject to the respective test method. As would be known to those of skill in the art, bath tissue and paper toweling are typically provided in a perforated roll format where the perforations are capable of separating the tissue or towel product into individual units. A 'user unit' is the typical finished product unit that a consumer would utilize in the normal course of use of that product. In this way, a single-, double, or even triple-ply finished product that a consumer would normally use would have a value of one user unit. For example, a common, perforated bath tissue or paper towel having a single-ply construction would have a value of 1 user unit between adjacent perforations. Similarly, a single-ply bath tissue disposed between three adjacent perforations would have a value of 2 user units. Likewise, any two-ply finished product that a consumer would normally use and is disposed between adjacent perforations would have a value of one user unit. Similarly, any three-ply finished consumer product would normally use and is disposed between adjacent perforations would have a value of one user unit.

It was also surprisingly found that irregular and asymmetrical embossing patterns 130A are found more appealing by consumers. Without desiring to be bound by theory, an optimized amount of surface area 142 occupied by the embossing pattern 130A and optimized embossing pattern 130A having an optimized placement of line emboss elements 132 and dot emboss elements 134 communicates a certain smoothness of the resulting two ply paper structure 100A to an end user. The emboss pattern has an aesthetic quality that does not appear overly complicated but simplistic in nature.

In order to determine the amount of surface area 142 occupied by the embossing pattern 130A, it is preferred to determine the perimeter 140 of the embossing pattern 130A. The perimeter 140 of embossing pattern 130A comprises the outermost deflection of each element comprising the periphery of the embossing pattern 130A out of the plane formed by the un-embossed portion 144 of two ply paper structure 100A. In other words the perimeter 140 of embossing pattern 130A is defined by the start of any z-direction displacement of the outermost elements comprising the periphery of embossing pattern 130A. If any discontinuity is present to between elements comprising the periphery of embossing pattern 130A, the perimeter 140 of the embossing pattern 130A is said to continue by placing a line that connects the closest points on adjacent elements comprising embossing pattern 130A. The perimeter 140 of embossing pattern 130A can also be known by those of skill in the art as the 'footprint' subtended by the periphery of embossing pattern 130A. The footprint of embossing pattern 130 and the resulting surface area 142 occupied by embossing pattern 130A of two ply paper structure 100A includes any line emboss elements 132A and dot emboss elements 134A contained within perimeter 140.

A preferred embodiment of the present invention provides a total embossment footprint area to total surface are of a sheet of a resulting paper structure ranging from about 5 percent to about 40 percent, more preferably ranging from about 8 percent to about 35 percent, even more preferably ranging from about 20 percent to about 25 percent, and most preferably about 23 percent. In a preferred embodiment, only embossing patterns 130A that are completely disposed upon the two ply paper structure 100A are utilized for the calculation of total embossment footprint area. However, one of skill in the art would be able to utilize such fractional portions of embossing patterns 130A in accordance with the present invention to determine the appropriate relationship of total embossment footprint area to total surface are of a sheet of a resulting paper structure.

The dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm"

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A web substrate having at least one embossed ply having a surface thereof, wherein said surface has surface area comprising from about 10.0 percent to about 20.0 percent line embossments.

2. The web substrate of claim 1 wherein said surface area comprises from about 12.0 percent to about 20.0 percent line embossments.

3. The web substrate of claim 2 wherein said surface area comprises from 0.0 percent to about 1.2 percent dot embossments.

4. The web substrate of claim 3 wherein said surface area comprises from about 0.3 percent to about 1.0 percent dot embossments.

5. The web substrate of claim 4 wherein the ratio of line embossment area to dot embossment area is greater than 1.

6. The web substrate of claim 1 wherein said surface area comprises from 0.0 percent to about 1.2 percent dot embossments.

7. The web substrate of claim 6 wherein the ratio of line embossment area to dot embossment area is greater than 1.

8. The web substrate of claim 1 wherein said web substrate is a fibrous structure.

9. The web substrate of claim 8 wherein said fibrous structure is a paper web.

10. The web substrate of claim 8 wherein said fibrous structure is through-air-dried.

11. A web substrate having at least two plies, one of said two plies having a surface and a surface area, the surface having an embossing pattern disposed thereon, wherein said embossing pattern has a surface area relative to said surface area of said one of said two plies comprising from about 10.0 percent to about 20 percent line embossments.

12. The web substrate of claim 11 wherein said embossing pattern has a surface area relative to said surface area of said one of said two plies comprising from about 12.0 percent to about 20 percent line embossments.

13. The web substrate of claim 12 wherein said embossing pattern has a surface area relative to said surface area of said one of said two plies comprising from about 0.0 percent to about 1.2 percent dot embossments.

14. The web substrate of claim 13 wherein the ratio of line embossment area to dot embossment area is greater than 1.

15. The web substrate of claim 11 wherein said embossing pattern has a surface area relative to said surface area of said one of said two plies comprising from 0.0 percent to about 1.2 percent dot embossments.

16. The web substrate of claim 15 wherein the ratio of line embossment area to dot embossment area is greater than 1.

17. The web substrate of claim 11 wherein said web substrate is a paper web.

18. The web substrate of claim 17 wherein said paper web is a tissue/towel product.

19. The web substrate of claim 17 wherein said web substrate is through-air-dried.

* * * * *